US006974018B2

(12) United States Patent
Lunardi et al.

(10) Patent No.: US 6,974,018 B2
(45) Date of Patent: Dec. 13, 2005

(54) HANDRAIL-DRIVE FOR AN ESCALATOR OR A MOVING WALK

(75) Inventors: Gerhard Lunardi, Vienna (AT); Michael Matheisl, Vienna (AT)

(73) Assignee: Inventio AG, Hergiswil (CH)

( * ) Notice: Subject to any disclaimer, the term of this patent is extended or adjusted under 35 U.S.C. 154(b) by 74 days.

(21) Appl. No.: 10/817,523

(22) Filed: Apr. 1, 2004

(65) Prior Publication Data

US 2004/0194404 A1 Oct. 7, 2004

(30) Foreign Application Priority Data

Apr. 4, 2003 (EP) ..... 03405227

(51) Int. Cl.[7] ..... B66B 23/06
(52) U.S. Cl. ..... 198/331; 198/330
(58) Field of Search ..... 198/330, 331

(56) References Cited

U.S. PATENT DOCUMENTS 785,882 A 3/1905 Hocquart
5,072,820 A * 12/1991 Steffen et al. ..... 198/331
5,125,494 A * 6/1992 Nurnberg et al. ..... 198/331
5,131,521 A * 7/1992 Johnson et al. ..... 198/331
5,522,492 A * 6/1996 Spriggs et al. ..... 198/331
5,566,810 A * 10/1996 Meyer et al. ..... 198/331
6,199,678 B1 * 3/2001 Reo ..... 198/330
6,450,317 B1 * 9/2002 Fargo et al. ..... 198/330

FOREIGN PATENT DOCUMENTS

CH 404 916 12/1965
EP 0 530 946 A1 3/1993

* cited by examiner

*Primary Examiner*—James R. Bidwell
(74) *Attorney, Agent, or Firm*—Schweitzer Cornman Gross & Bondell LLP

(57) ABSTRACT

An escalator has a step-band with steps for the transport of persons. The step-band is bounded on its sides by a balustrade held by a balustrade base. A handrail-drive drives the handrails, and has friction-wheels driving the handrails on the outside of the handrails. Rollers press upon the insides of the handrails, pressing the handrail against the friction-wheel. At least one further friction-wheel arranged on a step chain-wheel drives the friction-wheel through frictional or mechanical engagement.

7 Claims, 3 Drawing Sheets

HANDRAIL-DRIVE FOR AN ESCALATOR OR A MOVING WALK

The present invention relates to an escalator or a moving walk comprising a truss, a step-band with steps or a pallet-band with pallets for the transportation of persons and/or objects, and a balustrade which is held by a balustrade base and has a handrail, the handrail being driven by a handrail-drive.

BACKGROUND OF THE INVENTION

From patent specification EP 0 530 946 B1 an escalator has become known in which the handrail is guided on the outside of the handrail by a free-running wheel and on the inside of the handrail by two drive-wheels. The drive-wheels are connected by means of a drive-belt, the drive-belt pressing the handrail on the inside against the free-running wheel and moving the handrail with it. The drive-wheels are driven via belts by the step chain drive.

A disadvantage of the known device is that driving of the handrail takes place on the inside of the handrail by means of drive belts. If belt tension is reduced, there is insufficient friction on the free-running wheel to ensure driving of the handrail. Also, a large angle of wrap is required on the wheels, and there is much reverse bending of the handrail, which has a negative effect on the service life of the handrail.

BRIEF DESCRIPTIONS OF THE INVENTION

It is a purpose of the present invention to provide a handrail-drive that overcomes the shortcomings of the prior art, and provide a handrail-drive that drives the handrail of an escalator or moving walk in a positive and efficient manner. A handrail-drive in accordance with the invention drives the handrail on an outside of the handrail through contact by a friction-wheel. A press-on roller may engage the inside of the handrail to press the handrail against the friction-wheel.

The advantages achieved by the handrail-drive according to the invention include improved handrail guidance, and that a substantially shorter length of handrail is possible. The handrail does not cross the step-band or pallet-band, which has the advantage that the truss can be constructed more narrowly. The handrail is driven by frictional engagement on the outside, which has a greater coefficient of friction, as a result of which greater frictional forces are attainable with less reverse bending of the handrail. Overall, the handrail-drive according to the invention is constructed in a mechanically simple manner, and with fewer individual parts, which results in the further advantages of shorter installation times, less maintenance work, and lower manufacturing costs.

BRIEF DESCRIPTION OF THE DRAWINGS

The present invention is explained in more detail in the following description of a preferred but, nonetheless, illustrative embodiment thereof, in association with reference to the attached figures, wherein.

DETAILED DESCRIPTION OF THE INVENTION

Figure 1:
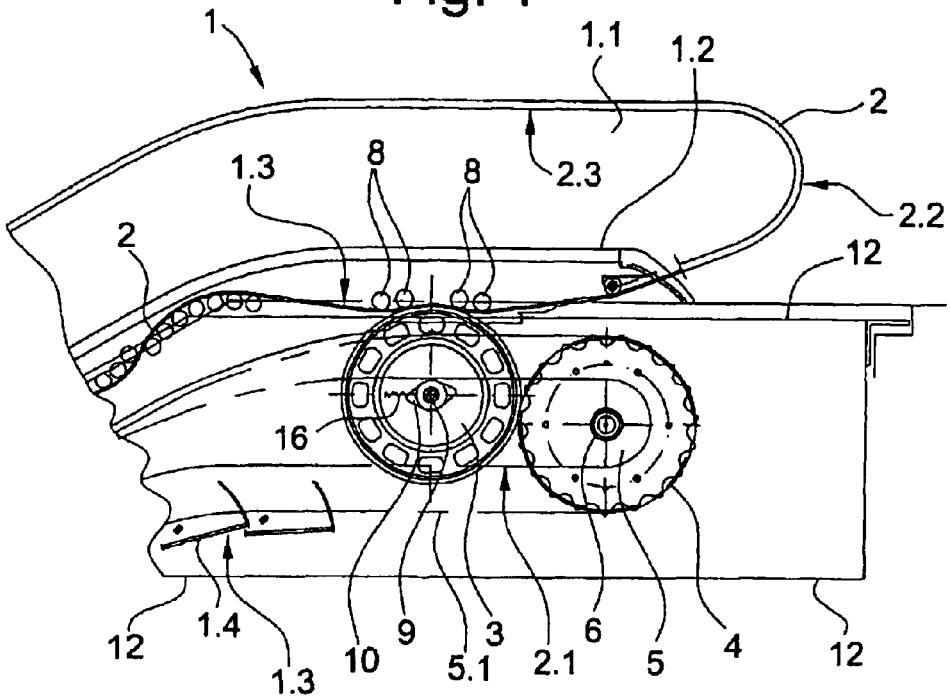
FIG. 1 is a side elevation view of a portion of an escalator with a handrail-drive according to the invention.

FIG. 1 shows an escalator 1 which has on each side a balustrade 1.1 with handrail 2, the balustrade 1.1 being held by a balustrade base 1.2. A step-band 1.3 which has steps 1.4 and carries persons abuts against the balustrade base 1.2 at its sides. A handrail-drive 2.1 drives the handrail 2, a friction-wheel 3 driving the handrail 2 by frictional engagement on the outside or hand-side 2.2. On the inside or gliding side 2.3 of the handrail 2, rollers 8 press the handrail 2 against the friction-wheel 3. A drive-wheel 4 arranged on a step chain-wheel 5 drives the friction-wheel 3 by frictional or mechanical engagement. The step chain-wheel 5 moves a step chain 5.1, on which the steps 1.4 are arranged.

FIGS. 1 to 5 show a frictional-engagement drive of the friction-wheel 3, there being a frictional engagement between drive-wheel 4 and friction-wheel 3.

A main shaft 6 which carries the step chain-wheels 5 is driven by means of a drive chain-wheel 7, the drive chain-wheel 7 being drivable by means of an escalator drive (chain drive and escalator motor) which is not shown.

The friction-wheel 3 is pressed against the drive-wheel 4 by means of a spring 16 and drives the handrail 2 by friction on the handrail outside 2.2. The friction-wheel 3 has, for example, a diameter of about 750 mm. On the inside or gliding-surface 2.3 of the handrail 2, press-on rollers 8 press the handrail 2 against the friction-wheel 3. The coefficient of friction of the handrail inside 2.3 is substantially lower than the coefficient of friction of the outside 2.2 of the handrail 2.

Figure 3:
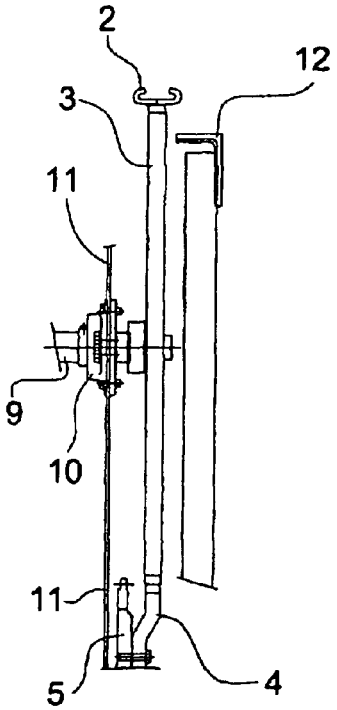
FIG. 3 is an end elevation view of the handrail-drive according to the invention.
Figure 2:
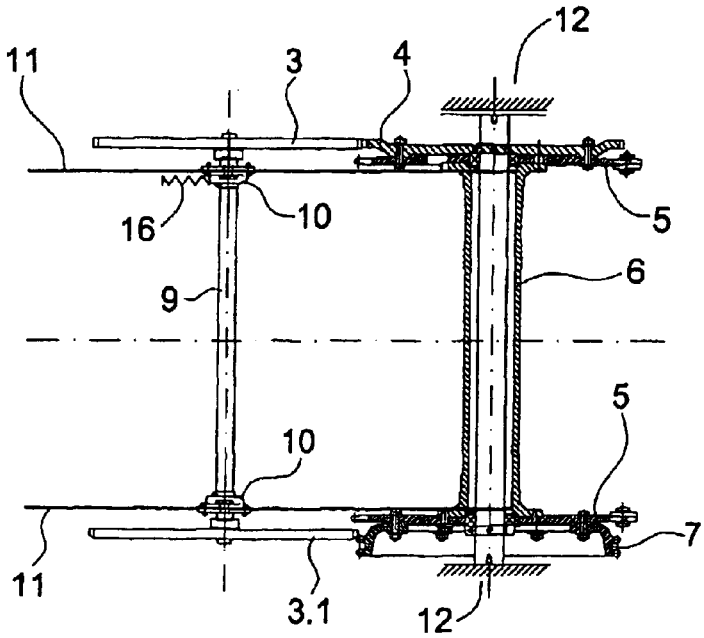
FIG. 2 is a plan view of the handrail-drive according to the invention.
Figure 3A:
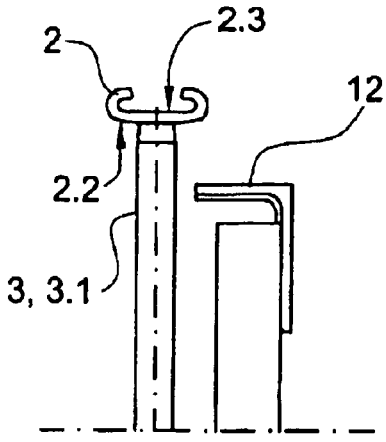
FIG. 3*a* is a detail of the upper portion of FIG. 3.

For the purpose of transmitting torque, the friction-wheel 3 on one side of the escalator is connected by means of a shaft 9 to the friction-wheel 3.1 on the other side of the escalator, press-on rollers 8 also pressing the handrail 2 against the friction-wheel 3.1. In the case of an escalator with an internal escalator drive, the friction-wheel 3.1 can also be driven by means of an additional drive-wheel. As shown in FIGS. 2 and 3, the shaft 9 is supported by means of bearings 10 in the end-plate 11.

Figure 4:
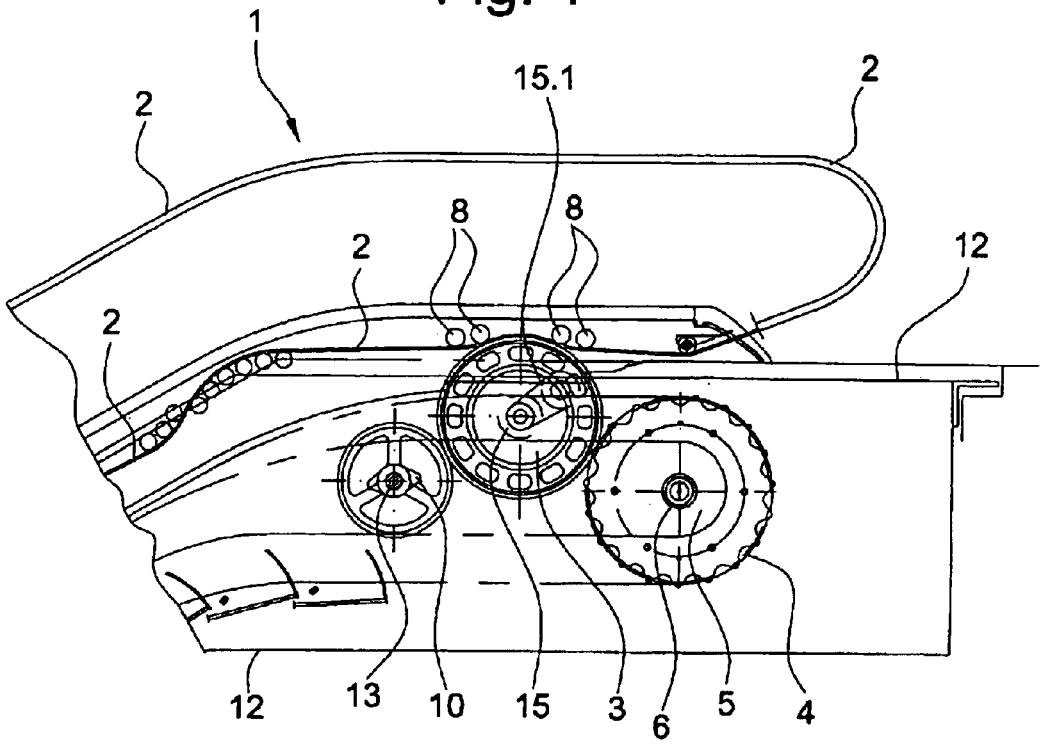
FIG. 4 is a side view of a further variant embodiment of the handrail-drive according to the invention.
Figure 5:
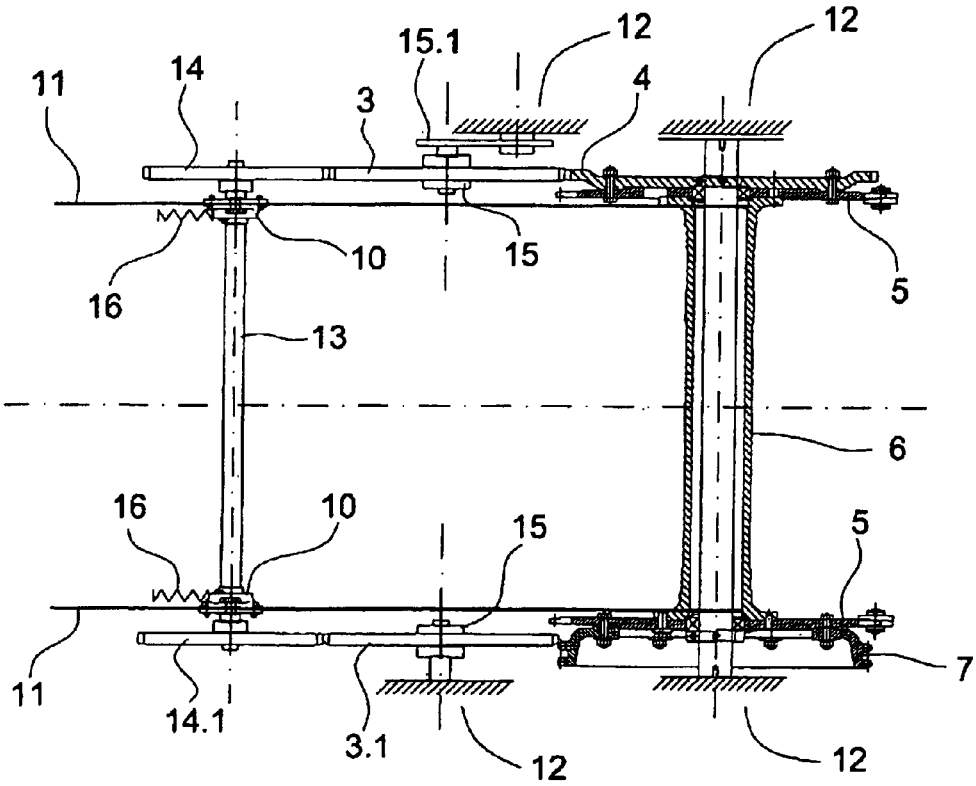
FIG. 5 is a plan view of the handrail-drive according to FIG. 4.

In the variant shown in FIGS. 4 and 5, the friction-wheels 3, 3.1 are arranged on the truss 12 and supported by means of bearings 15, the friction-wheel 3 being movably supported by means of a pivot-arm 15.1. A countershaft 13 with friction-wheels 14, 14.1 drives the friction-wheel 3.1 of the other side of the escalator. In this variant, there is no shaft 9, as a result of which there is space for cross-connectors of the truss 12.

Figure 6:
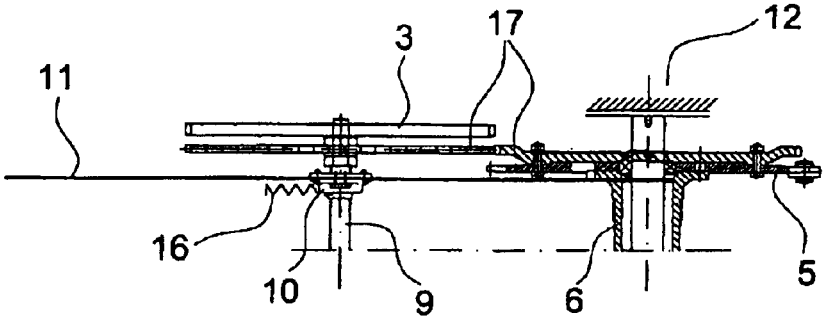
FIG. 6 is a plan view of a handrail-drive with driving toothed wheels.

FIG. 6 shows a drive of the friction-wheel 3 with a mechanical engagement with the step chain-wheel 5 in which, instead of the drive-wheel 4, a toothed wheel 17 is provided.

Figure 7:
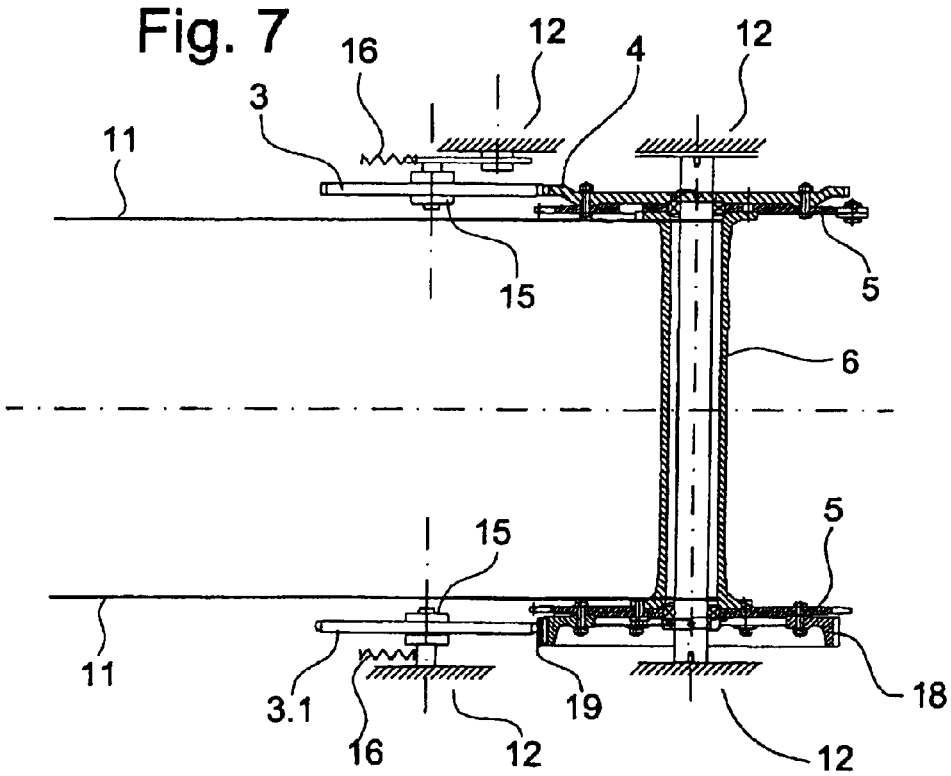
FIG. 7 is a plan view of a further variant embodiment of the handrail-drive.

FIG. 7 shows the handrail-drive 2.1 with friction-wheels 3, 3.1 which are driven separately from each other. The friction-wheel 3 of one side of the escalator is driven by means of the drive-wheel 4. In this variant embodiment, the drive chain-wheel 7 is replaced by a toothed-belt wheel 18, the toothed-belt wheel 18 and main shaft 6 being drivable by means of a toothed belt 19 which is passed over a toothed-belt pinion of the escalator motor. The friction-wheel 3.1 of the other side of the escalator is pressed by means of the spring 16 against the toothed-belt back of the toothed belt 19 and thereby driven by frictional engagement. This results in a constant speed and no slip. To improve the tractive capacity, the toothed-belt back can be provided with studs.

Advantageously, in this variant embodiment, fewer individual parts (no shaft 9, countershaft 13) are necessary. Without shafts, shorter installation times for the escalator drive and for the handrail-drive are possible.

The handrail-drive 2.1 according to the invention can also be used on moving walks. As used herein, the term "escalator" is to be construed as also encompassing moving walks, and the terms "step-band," "steps" and "escalator drive" encompassing pallet-bands, pallets and moving walk drives, respectively.

We claim:

1. An escalator, comprising a truss, a step-band with steps or a pallet-band with pallets for the transportation of persons and/or objects, a balustrade on each side of the step-band held by a balustrade base and having a handrail, and a handrail-drive driving the handrails, characterized in that the handrail-drive includes a friction-wheel for driving each of the handrails by frictional engagement on an outside, at least one press-on roller arranged on an inside of each handrail for pressing the handrail against the friction-wheel, and a drive-wheel for driving the friction-wheel by frictional engagement.

2. The escalator according to claim 1, further characterized in that the drive-wheel is arranged on a step chain-wheel.

3. The escalator according to claim 1, further characterized in that the friction-wheels are connected by a shaft for transmitting torque therebetween.

4. The escalator according to claim 1, further characterized in that one of the friction-wheels is driven by a belt of an escalator drive.

5. An escalator, comprising a truss, a step-band with steps or a pallet-band with pallets for the transportation of persons and/or objects, a balustrade on each side of the step-band held by a balustrade base and having a handrail, and a handrail-drive driving the handrails, characterized in that the handrail-drive includes a friction-wheel for driving each of the handrails by frictional engagement on an outside, and at least one press-on roller arranged on an inside of each handrail for pressing the handrail against the friction-wheel, the friction-wheels being connected by a countershaft having further friction-wheels.

6. The escalator according to claim 5, further characterized in that the handrail-drive includes a drive-wheel for driving the friction-wheel by frictional engagement.

7. The escalator according to claim 5, further characterized in that the handrail-drive includes a drive-wheel for driving the friction-wheel by mechanical engagement.

* * * * *